US009398806B2

(12) United States Patent
Mitchell

(10) Patent No.: US 9,398,806 B2
(45) Date of Patent: Jul. 26, 2016

(54) SNAP TOGETHER SAFETY STORAGE CABINET

(71) Applicant: EAGLE MANUFACTURING COMPANY, Wellsburg, WV (US)

(72) Inventor: Donald J. Mitchell, Wellsburg, WV (US)

(73) Assignee: EAGLE MANUFACTURING COMPANY, Wellsburg, WV (US)

( * ) Notice: Subject to any disclaimer, the term of this patent is extended or adjusted under 35 U.S.C. 154(b) by 0 days.

(21) Appl. No.: 14/499,898

(22) Filed: Sep. 29, 2014

(65) Prior Publication Data

US 2016/0088936 A1 Mar. 31, 2016

(51) Int. Cl.

*A47B 87/00* (2006.01)
*A47B 47/04* (2006.01)
*A47B 87/02* (2006.01)

(52) U.S. Cl.

CPC ..... *A47B 47/042* (2013.01); *A47B 87/008* (2013.01); *A47B 87/0292* (2013.01)

(58) Field of Classification Search

CPC ..... A47B 87/02; A47B 87/0276; A47B 87/0284; A47B 87/007; A47B 87/008; A47B 47/04; A47B 47/042; A47B 87/0292
USPC ..... 312/108, 109, 111, 263, 265.5
See application file for complete search history.

(56) References Cited

U.S. PATENT DOCUMENTS 3,712,697 A * 1/1973 Kelley ..... E06B 9/115 312/240
4,171,150 A 10/1979 Soderlund
4,238,044 A 12/1980 Roddier
4,782,972 A 11/1988 Wenkman et al.
4,826,265 A * 5/1989 Hockenberry ..... A47B 81/00 108/901
4,940,155 A 7/1990 Hewson
5,048,902 A 9/1991 Daly
5,372,415 A * 12/1994 Tisbo ..... A47B 47/042 108/109
5,466,058 A 11/1995 Chan
5,704,699 A 1/1998 Pagelow et al.
5,921,646 A 7/1999 Hwang
6,099,092 A * 8/2000 Uffner ..... A47B 47/00 16/374
6,193,340 B1 2/2001 Schenker et al.
6,332,659 B1 * 12/2001 Cook ..... A47B 47/05 220/617
6,474,759 B2 11/2002 Hsu
6,626,017 B2 * 9/2003 Herbeck ..... F16B 2/18 138/147
7,028,859 B2 4/2006 Moon et al.
7,182,415 B2 * 2/2007 Yamada ..... A47B 87/0215 312/107
7,798,740 B2 * 9/2010 Kaufman ..... F16B 12/38 211/189
8,388,073 B2 3/2013 Richter
9,113,704 B2 * 8/2015 Hewitt ..... A47B 61/00
2002/0043905 A1 * 4/2002 Insalaco ..... A47B 47/05 312/108
2002/0058445 A1 * 5/2002 Tamura ..... G06F 1/181 439/717
2002/0125799 A1 * 9/2002 Landsberger ..... A47B 47/0091 312/209
2008/0049949 A1 * 2/2008 Snider ..... H04B 1/082 381/86

(Continued)

*Primary Examiner* — Hanh V Tran
(74) *Attorney, Agent, or Firm* — Kratz, Quintos & Hanson, LLP

(57) ABSTRACT

A molded plastic storage cabinet having a plurality; of panels that can be snap-fit together. The cabinet has a door panel serving as a door, the door panel being symmetric about a horizontal centerline; a back panel; a pair of side panels, each side panel being symmetric about a horizontal centerline; and a top panel and a bottom panel, each arranged to connect to the back and side panels, and each having a hinge/latch pin at ends of a front edge. The door panel has a hinge cavity at one end and a door latch at the other end of a top and a bottom edge, to permit latching or hinging of the door panel on the hinge/latch pins.

16 Claims, 9 Drawing Sheets

(56) References Cited

U.S. PATENT DOCUMENTS

2012/0079791 A1* 4/2012 Lord ..... H05K 5/0021 52/775

2013/0342091 A1* 12/2013 Walker ..... H05K 5/0247 312/265.5

* cited by examiner

SNAP TOGETHER SAFETY STORAGE CABINET

FIELD OF THE INVENTION

The invention relates to a safety storage cabinet constructed of injection molded plastic panels. The panels are configured to be snapped together, without the use of tools, to result in an assembled safety storage cabinet. The safety storage cabinet is primarily intended for use in storing acids and corrosive liquids contained in bottles or storage containers.

BACKGROUND OF THE INVENTION

Cabinets for storing containers of hazardous materials in commercial and industrial settings are required by various safety regulations. Prior art safety storage cabinets, especially those having a large capacity, are bulky and thus difficult and expensive to ship to a purchaser. Other prior art safety cabinets, that are in a dismantled state for shipping, require time-consuming assembly using a variety of tools.

BRIEF SUMMARY OF THE INVENTION

The present invention is a molded plastic storage cabinet having a plurality of panels that can be snap-fit together. The panels are a door panel serving as a door, the door panel being symmetric about a horizontal center line; a back panel; a pair of side panels, each side panel being symmetric about a horizontal centerline; a top panel and a bottom panel, each arranged to connect to the back and side panels, and each having a hinge/latch pin at ends of a front edge. The door panel has a hinge cavity at one end and a door latch at the other end of a top and a bottom edge, to permit latching or hinging of the door panel on the hinge/latch pins.

In one embodiment of the molded plastic storage cabinet having a plurality of panels that can be snap-fit together, one of the pair of side panels is provided with a hasp having an opening for a lock, and the door panel is provided with an opening to receive the hasp, whereby the door may be secured with a padlock or the like.

In another embodiment of the molded plastic storage cabinet having a plurality of panels that can be snap-fit together, the pair of side panels may be reversed and rotated 180 degrees and the door panel is arranged to rotate 180 degrees so as to allow the door to open and close in directions opposite that before the reversal of the side panels.

In still another embodiment, of the molded plastic storage cabinet having a plurality of panels that can be snap-fit together, sumps are provided in at least one of the top and bottom panels.

In still a further embodiment of the molded plastic storage cabinet having a plurality of panels that can be snap-fit together, shelf supports are provided on the pair of side panels and back panel, and shelves are provided that are arranged to be mounted on the shelf supports.

In still a further embodiment of the molded plastic storage cabinet having a plurality of panels that can be snap-fit together, the shelf supports include ridges and the shelves have grooves which interlock with the ridges to hold each shelf from sliding outwardly when containers are removed from the shelves.

In still a further embodiment of the molded plastic storage cabinet having a plurality of panels that can be snap-fit together, locking slots and locking tab retainers are provided in the bottom panel and the top panel, and edges of the side panels and the back panel engage with respective locking tab retainers to retain the side panels and back panel in the bottom panel and top panel.

In still a further embodiment of the molded plastic storage cabinet having a plurality of panels that can be snap-fit together, a lock well is provided in each of the top panel and the bottom panel and a lock key is provided arranged to be inserted into the lock wells to enable locking of one cabinet atop another in locked relationship.

In still a further embodiment of the molded plastic storage cabinet having a plurality of panels that can be snap-lit together, I-beam locks are provided arranged to be inserted into the lock wells to enable locking of one cabinet to another in a side-by-side relationship.

In still a further embodiment of the molded plastic storage cabinet having a plurality of panels that can be snap-fit together, L-brackets are provided and attach to a cabinet for mounting a cabinet to a wall.

In still a further embodiment of the molded plastic storage cabinet having a plurality of panels that can be snap-fit together, lock wells of the top panel and bottom panel are the same configuration and dimensions and are used for attachment with both the snap keys and the I-beam locks.

In still a further embodiment of the molded plastic storage cabinet having a plurality of panels that can be snap-fit together, the cabinet is formed of high-density polyethylene.

DETAILED DESCRIPTION OF THE INVENTION

Figure 1:
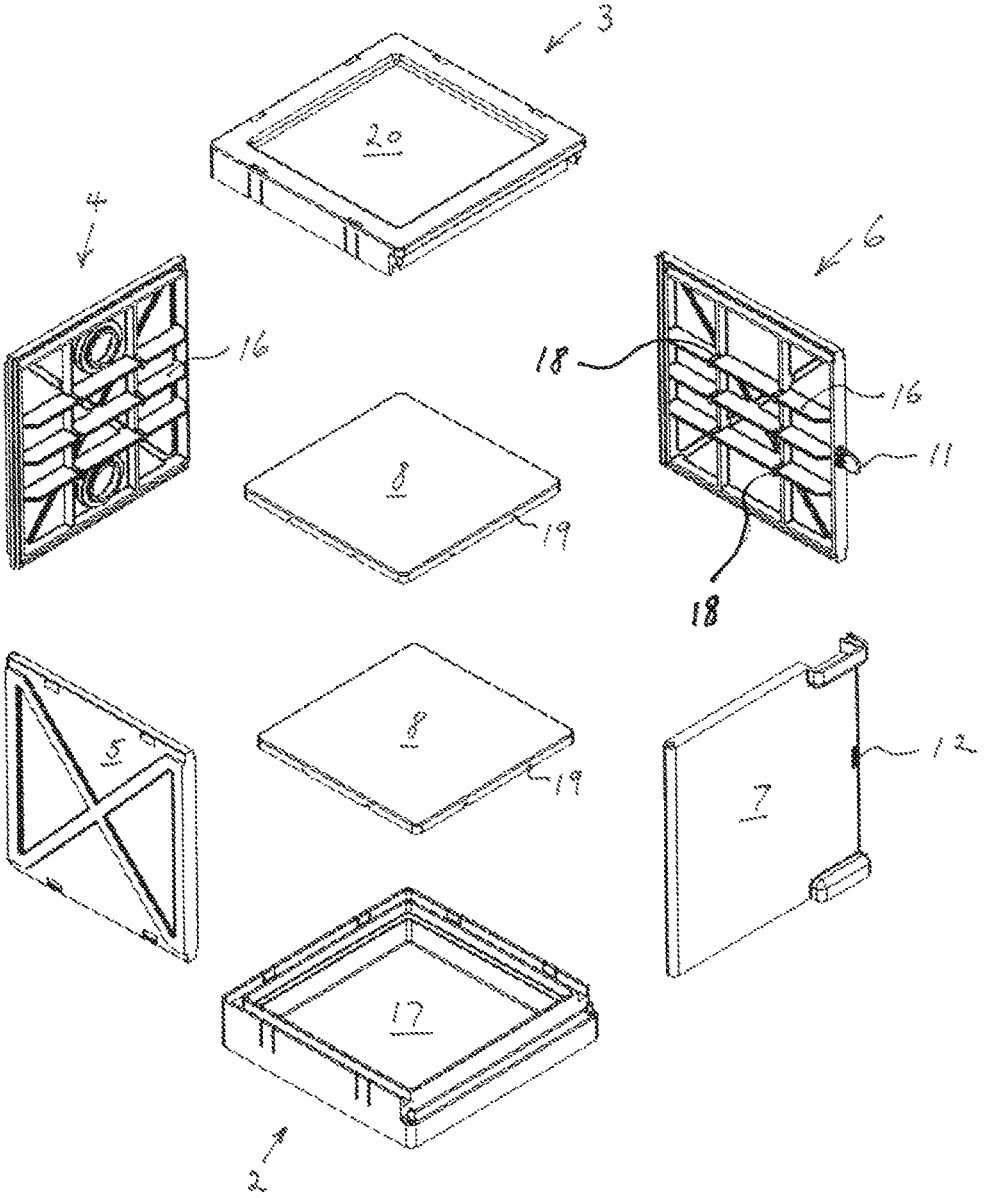
FIG. 1 is an exploded view of the safety storage cabinet of the invention.

Components of the safety storage cabinet 1, in a disassembled state, are shown in FIG. 1. The components are bottom panel 2, top panel 3, back panel 4, side panel 5, side panel with hasp 6, front door panel 7, and shelf panels 8. All of the panels are preferably molded of a plastic such as high-density polyethylene (HDPE), however, other moldable thermoplastic materials are available in practice of the invention. HDPE is preferred because of its strength and rigidity, as well as its resistance to most materials that might be stored in the cabinet, such as acids and corrosive liquids. All of the components of the cabinet are preferably injection molded in a single mold. When the cabinet, is not in an assembled state, all of the components of the cabinet can be easily stacked in the flat position, resulting in a compact stack that is convenient for shipping, for example when purchased.

The components are easily assembled to form the cabinet 1, without the use of tools. In the following description of the cabinet, terms such as horizontal and vertical are in relation to the cabinet having its bottom panel on a floor. Terms such as left and right are in relation to facing the outside of the front door panel.

Figure 2:
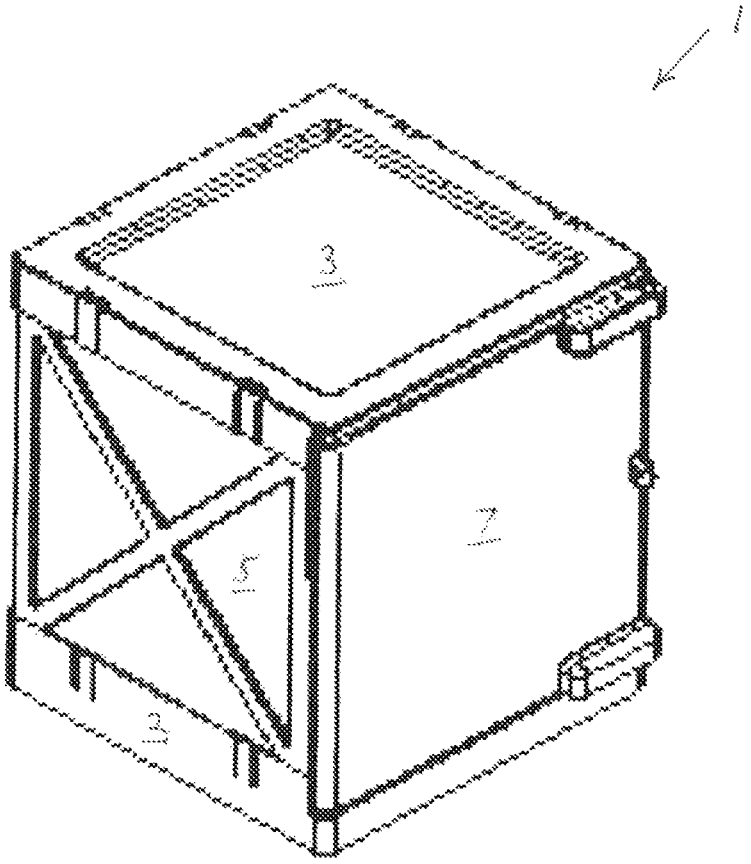
FIG. 2 is a perspective view of the components of the safety storage cabinet of FIG. 1 in an assembled state.

An assembled cabinet 1 using the components shown in FIG. 1 is shown in FIG. 2. To assemble the cabinet, the two side panels and the back panel are attached to the bottom panel by inserting bottom edges of the two side panels and the back panel into locking slots 10 of the bottom panel, as shown in an enlarged view in FIG 6. Upon fully inserting the bottom edges of the side panels and back panel into a locking slot, the bottom edge is prevented from being removed by action of a locking tab 9, unless purposely released. The locking tab 9 and bottom edge are more clearly described below.

The preferred order of assembly is to first attach the back panel 4 to the bottom panel 2. Next the side panels 5 and 6 are attached to the bottom panel. As shown in FIG. 1, one of the side panels, that is side panel 6, is provided with a hasp 11, which can pass through hasp slot 12 on the front door panel 7, when assembled.

A feature of the invention is the symmetry of both side panels about a horizontal centerline, which enables a horizontal edge of a side panel to be contacting either the top panel 3 or die bottom panel 2, when assembled. It is this symmetry that enables the door panel 7 to have a left-handed or right-handed operation. If a left-handed option is desired, the side panel 6 having the hasp should be on the right side of the cabinet, in relation to facing the front door panel opening. If a right-handed operation is desired, the side panel 6 having the hasp should be on the left side of the cabinet, in relation to facing the front door panel opening.

Figure 3:
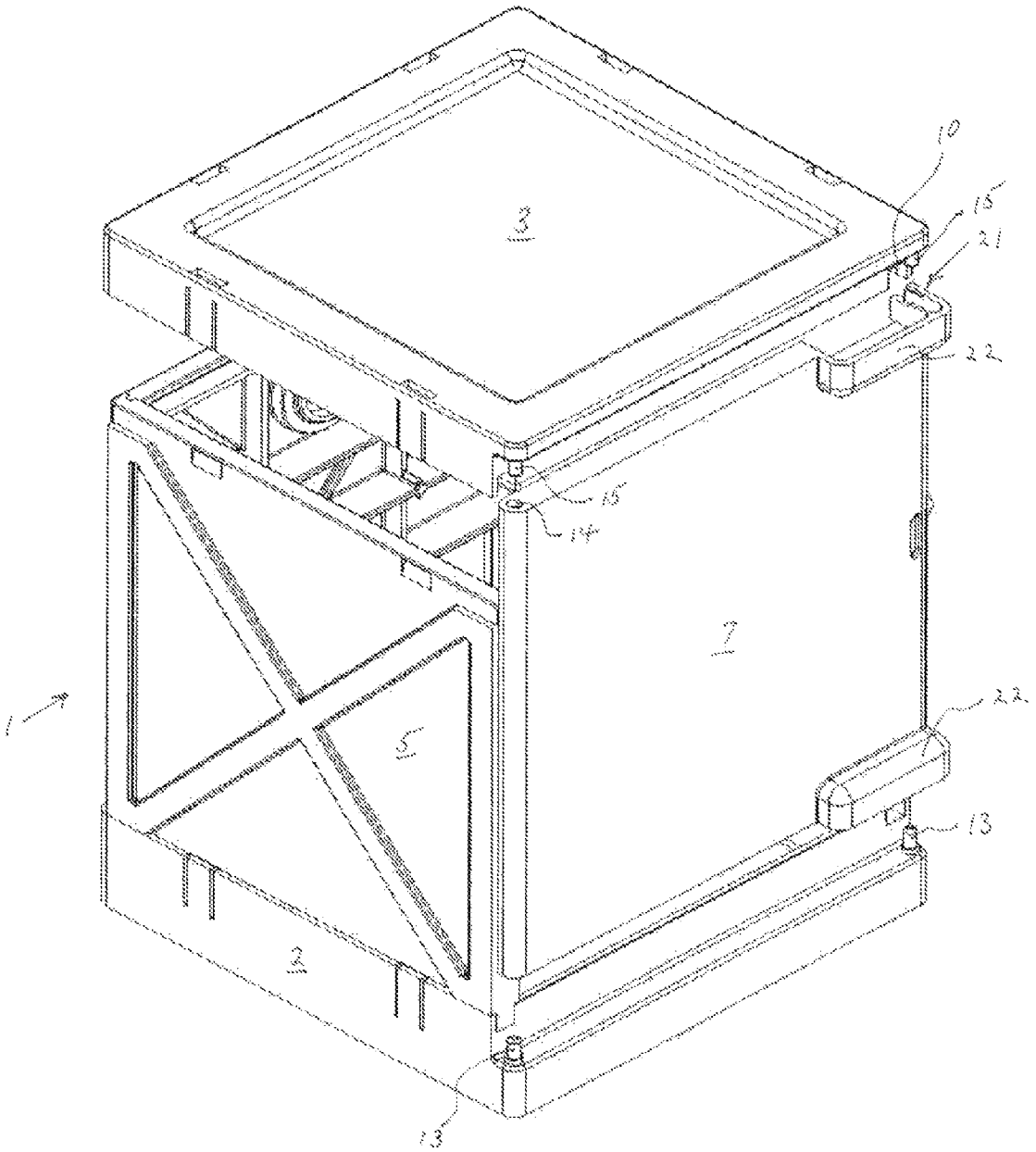
FIG. 3 is a perspective view of the safety storage cabinet of the invention, for showing a step in the assembly of the cabinet.

Following assembly of the bottom, panel 2, back panel 4 and side panels 5 and 6, the front door panel 7 is placed onto hinge/latch pin 13 of the bottom panel by inserting the hinge/latch pin into a hinge cavity 14 of the door panel, as shown in FIG. 3. The door panel is symmetrical about a horizontal centerline, therefore the door panel can be placed in a manner to obtain either a left-handed or a right-handed door operation.

Following placement of the front door panel 7, top panel 3 is assembled by first aligning all of the top edges of the back panel and side panels with all of the locking slots 10 of the top panel. The locking slots 10 of the top panel are similar to the locking slots 10 of the bottom panel shown in FIG. 6. Also, a downward directed hinge/latch pin 15 of the top panel must be aligned with the hinge cavity 14 of the door panel. Following the alignment, described above, the top panel is snapped into place by fully inserting all of the top edges into the locking slots 10 and the hinge/latch pin 15 into the hinge cavity 14.

The safety storage cabinet includes shelf panels 8 (FIG. 1) which are slidable onto shelf supports 16 of the back and side panels. Also, one shelf panel can be placed onto a shelf support just above a bottom panel sump 17. The shelf supports of the side panels include ridges 18 which interlock with shelf grooves 19 along edges of the shelves to hold each shelf from sliding outwardly when containers or the like are being removed from the shelves.

The bottom panel 2 includes the bottom panel sump 17, which serves to contain any material that might spill from contents of the cabinet. Also, top panel 3 includes in its upper surface a sump 20 provided to contain any material spilled when using the top panel as a working surface.

The hinge/latch pins 13 of the bottom panel and hinge/latch pins 15 of the top panel serve dual purposes. The top panel includes a downward directed hinge/latch pin 15 at each corner near the door opening, as best shown in FIG. 3. The bottom panel includes an upward directed hinge/latch pin 13 at each corner near the front opening, as shown in FIG. 3. The hinge/latch pins 13 and hinge/latch pins 15 are of the same shape and dimensions. The function of each hinge/latch pin depends on whether the door panel is installed to have a left-handed or a right-handed operation. For example, when the door panel is installed to have a left-handed operation, the hinge/latch pins 13 and 15 near the left side of the door opening are inserted into the hinge cavities 14 of the door panel to form a pair of hinges for the door panel. Also, the hinge/latch pins 13 and 15 near the right side of the door opening provide a pin around which door latch 21 of door handle 22 can engage to keep the door panel closed. Preferably the door panel includes a top and a bottom door handle 22, each incorporating a door latch 21.

Figure 4:
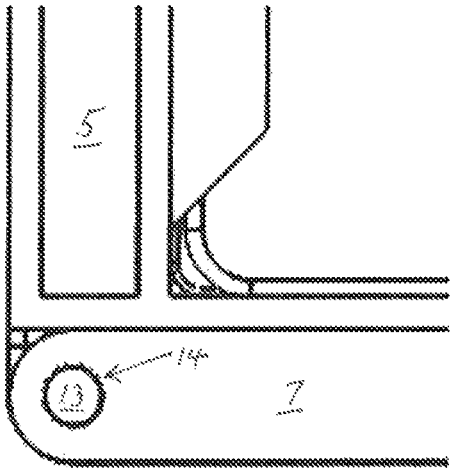
FIG. 4 is a cross-sectional view of a hinge/latch pin and a hinge cavity for showing the hinge/latch pin being used as a hinge component of the invention.

FIG. 4, an enlarged view of a portion of a side panel 5 and a front door panel 7, shows a hinge/latch pin 13 of a bottom panel 2 being used as a hinge for the door panel 7. The hinge/latch pin 13 is inserted in hinge cavity 14 of the front door panel 7.

Figure 5:
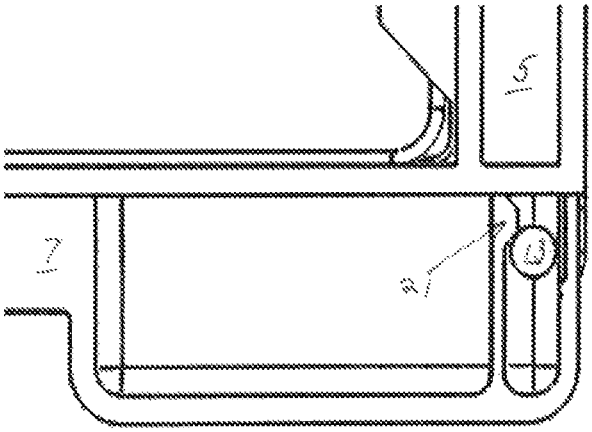
FIG. 5 is an enlarged view of a hinge/latch pin and a door latch for showing the hinge/latch pin being used as a latching component of the invention.

FIG. 5, an enlarged view of a portion of a side panel 5 and a front door panel 7, shows a hinge/latch pin 13 of a bottom panel 2 being used to accept a door latch 21 on the front door panel 7.

Hinge/latch pins 15 of the top panel 3 are used in the same manner as the hinge/latch pins 13 of the bottom panel 2, described in FIGS. 4 and 5.

Figure 6:
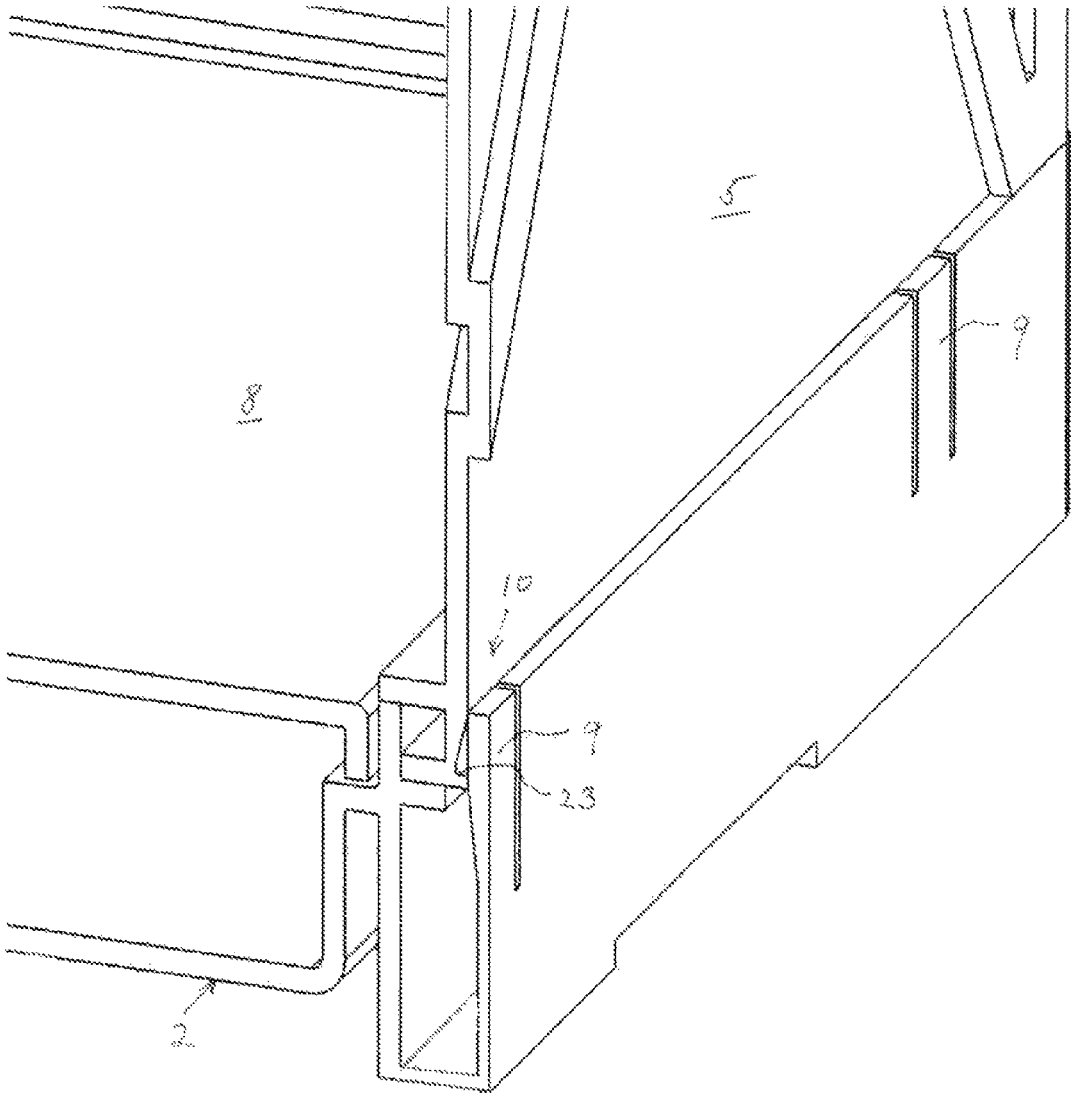
FIG. 6 is an enlarged view of a horizontal edge of a side panel and a locking slot of the invention for showing the operation of the locking slot and the operation of releasing the horizontal edges.

As described above, the panels of the safety storage cabinet are easily snapped together to form the cabinet. Assembly is performed without the use of any tools. Preferably each locking slot 10 is configured as shown in FIG. 6. FIG. 6 is a vertical cross-section of a horizontal edge of a side panel 5 and a locking slot 10 of the bottom panel 2, Locking tab retainer 23 contacts a ridge along the horizontal edge of the side panel 5 in order to retain the side panel in the bottom panel. The back panel inserted into the bottom panel, as well as the side and back panels inserted into the top panel are retained in the same manner.

The safety storage cabinet 1 is easily disassembled by releasing all of the side and back panel horizontal edges that are inserted into the locking slots 10. Referring to FIG. 6, in order to remove a side panel or a back panel from a top panel or a bottom panel, locking tab 9, having locking tab retainer 23, is flexed outwardly to move the locking tab retainer 23 from contacting a ridge along the horizontal edges of the side panels and back panels.

Two or more cabinets are stackable and inter-lockable when placed on top of each other. Also, two or more cabinets are inter-lockable when placed side-by-side with each other.

Figure 7:
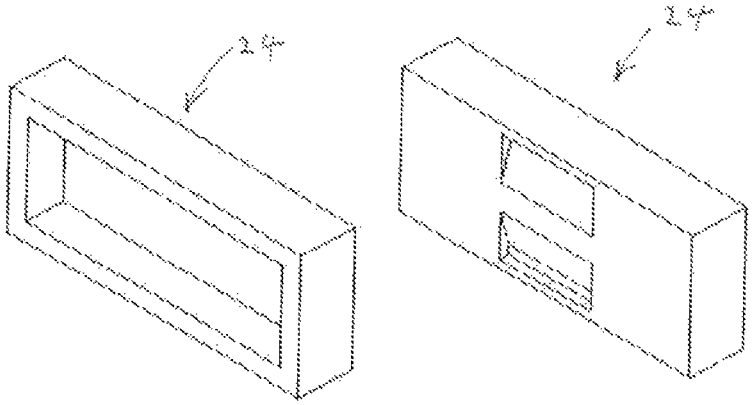
FIG. 7 is a perspective view of a snap key of the invention, for use in interlocking stacked cabinets of the invention.
Figure 10:
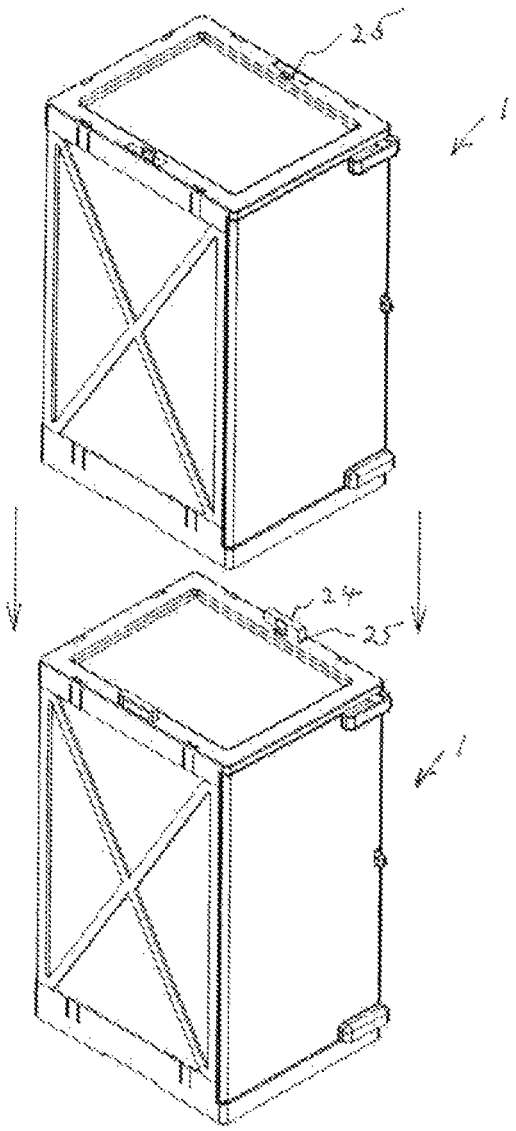
FIG. 10 is a perspective view of two cabinets of the invention aligned for stacking using the snap key of FIG. 7.

Two cabinets are stackable and inter-lockable by using snap keys 24, as shown in FIG. 7. A snap key is inserted into each lock well 25 in the top panel of the cabinet that is to be the bottom cabinet of the stack, as shown in FIG. 10. Then, the cabinet that is to be the top cabinet of the stack is positioned to be aligned with the bottom cabinet and lowered until both snap keys latch onto the bottom panel of the top cabinet. FIG. 10 shows two cabinets in position to be inter-connected together. The snap keys 24 are shown in place in lock wells 25 of the bottom cabinet. Additional cabinets can be added to the top cabinet of the stack in a similar manner.

Figure 8:
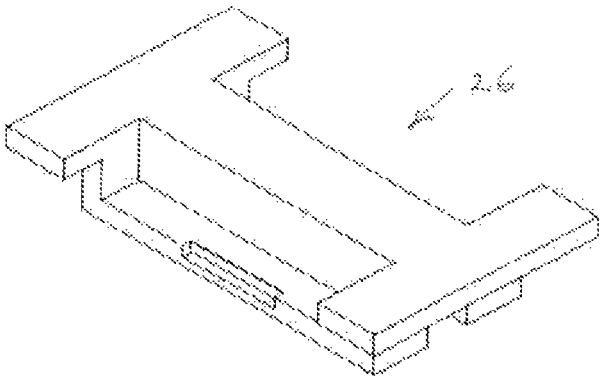
FIG. 8 is a perspective view of a I-beam lock of the invention, for use in interlocking side-by-side cabinets of the invention.
Figure 11:
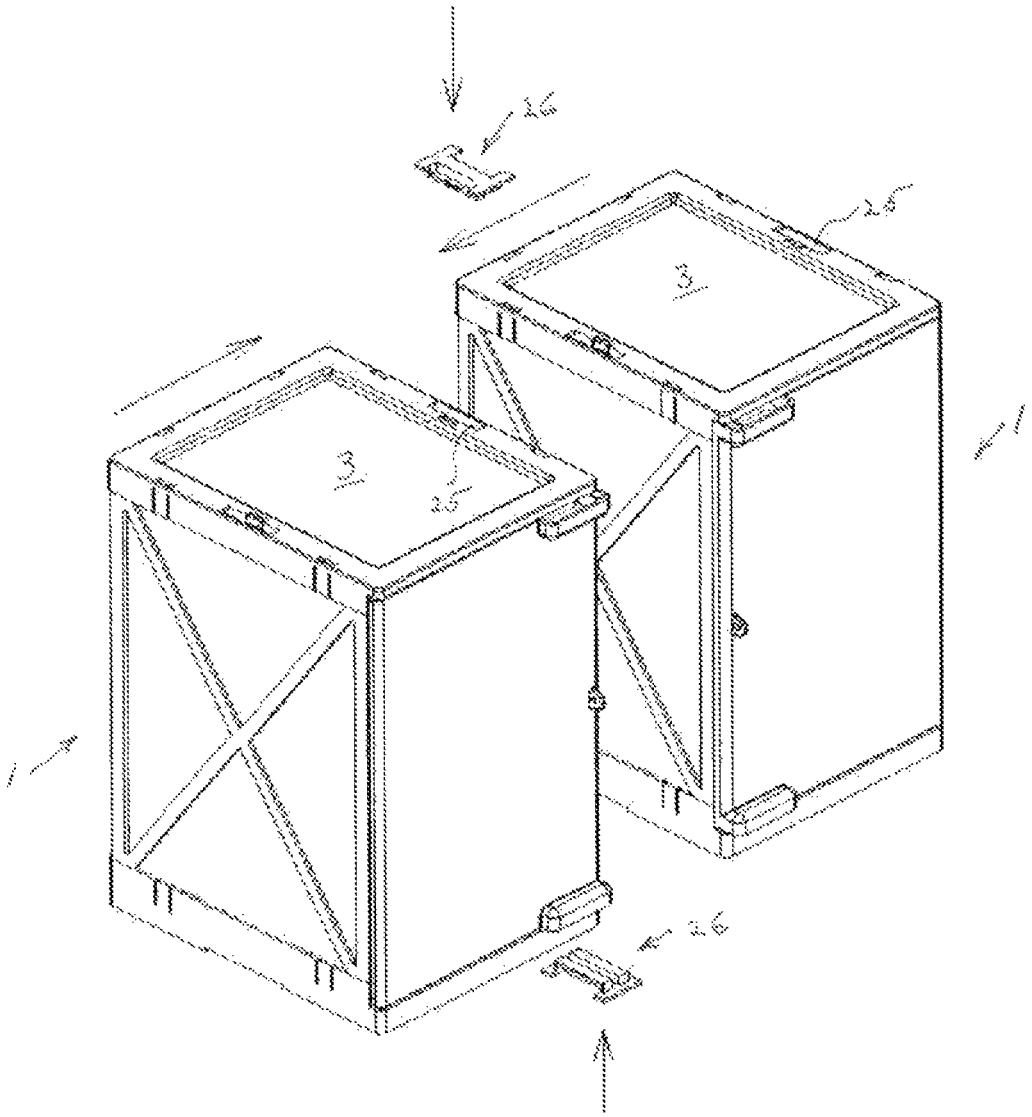
FIG. 11 is a perspective view of two cabinets of the invention aligned for locking side-by-side using the I-beam lock of FIG. 8.

Two cabinets are inter-lockable side-by-side by using I-beam locks 26, as shown in FIG. 8. An I-beam lock is inserted into lock wells 25 (FIG. 11), located in top panels 2 of side-by-side positioned cabinets, and an I-beam lock is also inserted into lock wells 25 (not shown), located in bottom panels of the side-by-side positioned cabinet. FIG. 11 shows two cabinets in position to be inter-locked together side-by-side. The I-beam locks 26 are shown between the cabinets near the lock wells 25. The I-beam locks are inserted when the cabinets are positioned side-by-side in contact with each other.

The lock wells 25 of the top panel 3, and the lock wells 25 of the bottom panel 2 are the same configuration and dimensions, and are used for attachment with both snap keys 24 and I-beam locks 26.

Figure 9:
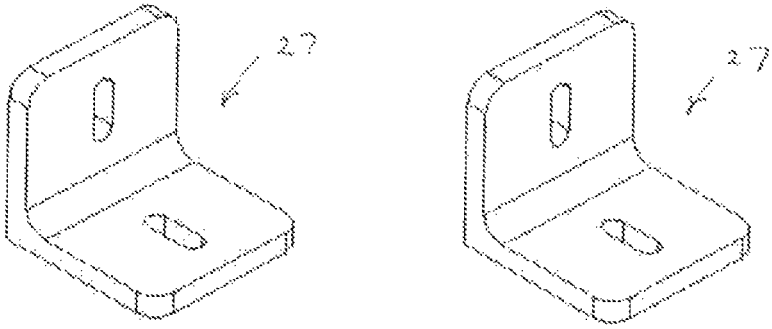
FIG. 9 is a perspective view of an L-bracket of the invention for mounting one or more cabinets to a wall.
Figure 12:
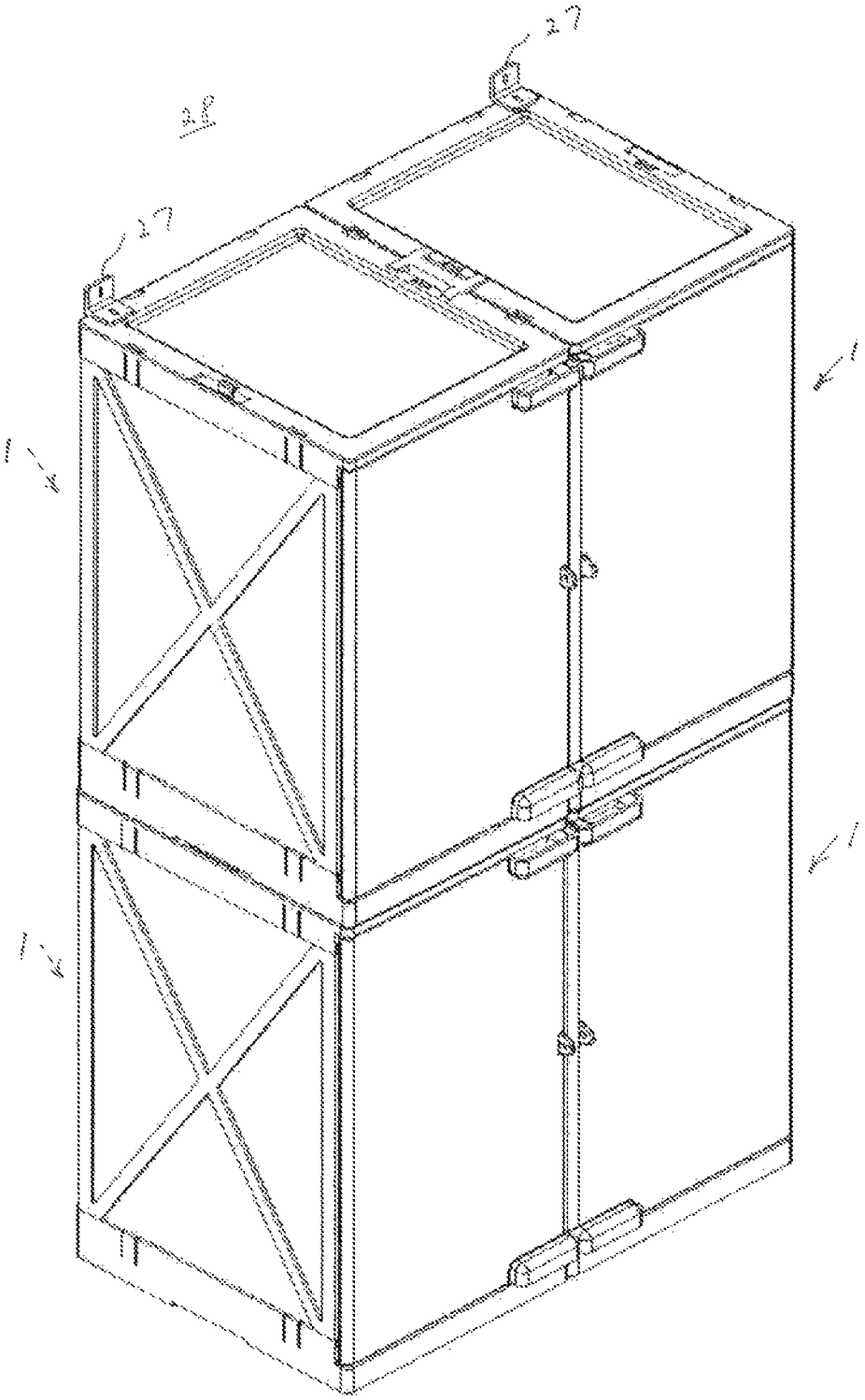
FIG. 12 is a perspective view of two cabinets of the invention mounted to a wall, using the L-brackets of FIG. 9

Cabinets of the invention may also include L-brackets 27 as shown in FIG. 9 for mounting a single cabinet, stacked cabinets, or side-by-side cabinets to a wall. To mount to a wall, each cabinet must be completely assembled, as shown in FIG. 12, and positioned against a wall 28. L-brackets 27 are preferably screwed to back outside corners of the cabinet or cabinets, and then the L-brackets are screwed to the wall.

What is claimed is:

1. A molded plastic storage cabinet having a plurality of panels that can be snap-fit together, comprising:

a door panel serving as a door, the door panel being symmetric about a horizontal centerline;

a back panel;

a pair of side panels, each side panel being symmetric about a horizontal centerline; and a top panel and a bottom panel, each arranged to connect to the back and side panels, and each having a hinge/latch pin at ends of a front edge;

the door panel having a hinge cavity at one end and a door latch at the other end of a top and a bottom edge, to permit latching or hinging of the door panel on the hinge/latch pins; and wherein locking slots are provided in the bottom panel and the top panel, and outwardly flexible locking tabs having locking tab retainers are provided at accessible outer walls of the bottom panel and the top panel, each flexible locking tab being formed by providing a pair of spaced apart slits in the bottom panel and top panel, said pair of slits separating each flexible locking tab from remaining portions of the bottom panel and top panel, and a ridge along horizontal edges of the side panels and the back panel engage with the outwardly flexible locking tab retainers to retain the side panels and back panel in the bottom panel and top panel and disassembly of the molded plastic storage cabinet can be carried out by outwardly flexing the locking tab retainers to release the side panels and back panel from the bottom panel and top panel.

2. The molded plastic storage cabinet having a plurality of panels that can be snap-fit together according to claim 1, wherein one of the pair of side panels is provided with a hasp having an opening for a lock, and the door panel is provided with an opening to receive the hasp, whereby the door may be secured with a lock.

3. The molded plastic storage cabinet having a plurality of panels that can be snap-fit together according to claim 1, wherein the pair of side panels may be reversed and rotated 180 degrees and the door panel is arranged to rotate 180 degrees so as to allow the door to open and close in directions opposite that before the reversal of the side panels.

4. The molded plastic storage cabinet having a plurality of panels that can be snap-fit together according to claim 1, wherein sumps are provided in at least one of the top and bottom panels.

5. The molded plastic storage cabinet having a plurality of panels that can be snap-fit together according to claim 1, wherein sumps are provided in both the top panel and the bottom panel.

6. The molded plastic storage cabinet having a plurality of panels that can be snap-fit together according to claim 1, wherein shelf supports are provided on the pair of side panels and back panel, and shelves are provided that are arranged to be mounted on the shelf supports.

7. The molded plastic storage cabinet having a plurality of panels that can be snap-fit together according to claim 6, wherein the shelf supports include ridges and the shelves have grooves which interlock with the ridges to hold each shelf from sliding outwardly when containers are removed from the shelves.

8. The molded plastic storage cabinet having a plurality of panels that can be snap-fit together according to claim 1, wherein a lock well is provided in each of the top panel and the bottom panel and a lock key is provided arranged to be inserted into the lock wells to enable locking of one cabinet atop another in locked relationship.

9. The molded plastic storage cabinet having a plurality of panels that can be snap-fit together according to claim 8, wherein I-beam locks are provided arranged to be inserted into the lock wells to enable locking of one cabinet to another in a side-by-side relationship.

10. The molded plastic storage cabinet having a plurality of panels that can be snap-lit together according to claim 9, wherein L-brackets are provided attached to the cabinet for mounting the cabinet to a wall.

11. The molded plastic storage cabinet having a plurality of panels that can be snap-fit together according to claim 9, wherein the lock wells of the top panel and bottom panel are the same configuration and dimensions and are used for attachment with both the snap keys and the I-beam locks.

12. The molded plastic storage cabinet having a plurality of panels that can be snap-fit together according to claim 1, wherein the cabinet is formed of high-density polyethylene.

13. A molded plastic storage cabinet having a plurality of panels that can be snap-fit together, comprising:

a door panel serving as a door, the door panel being symmetric about a horizontal centerline:

a back panel;

a pair of side panels, each side panel being symmetric about a horizontal centerline; and a top panel and a bottom panel, each arranged to connect to the back and side panels, and each having a hinge/latch pin at ends of a front edge;

the door panel having a hinge cavity at one end and a door latch at the other end of a top and a bottom edge, to permit latching or hinging of the door panel on the hinge/latch pins; wherein the pair of side panels may be reversed and rotated 180 degrees and the door panel is arranged to rotate 180 degrees so as to allow the door to open and close in a direction opposite that before the reversal of the side panels:

one of the pair of side panels is provided with a hasp having an opening for a lock, and the door panel is provided with an opening to receive the hasp whereby the door may be secured with a lock; and wherein locking slots are provided in the bottom panel and the top panel, and outwardly flexible locking tabs having locking tab retainers are provided at accessible outer walls of the bottom panel and the top panel, each flexible locking tab being formed by providing a pair of spaced apart slits in the bottom panel and top panel, said pair of slits separating each flexible locking tab from remaining portions of the bottom panel and top panel, and a ridge along horizontal edges of the side panels and the back panel engage with the outwardly flexible locking tab retainers to retain the side panels and back panel in the bottom panel and top panel and disassembly of the molded plastic storage cabinet can be carried out by outwardly flexing the locking tab retainers to release the side panels and back panel from the bottom panel and top panel.

14. The molded plastic storage cabinet having a plurality of panels that can be snap-fit together according to claim 13, wherein sumps are provided in the top panel and the bottom panel.

15. The molded plastic storage cabinet having a plurality of panels that can be snap-fit together according to claim 13, wherein shelf supports having ridges are provided on the pair of side panels and back panel, and shelves are provided with grooves which interlock with ridges of the shelf supports.

16. The molded plastic storage cabinet having a plurality of panels that can be snap-fit together according to claim 13, wherein a lock well is provided in each of the top panel and bottom panel and a locking key is provided arranged to be inserted into the lock wells to enable locking of one cabinet, atop another in locking relationship, and I-beam locks are provided arranged to be inserted into the lock wells to enable locking of one cabinet to another in a side-by-side relationship.

* * * * *